US009797587B2

(12) United States Patent
Harbers et al.

(10) Patent No.: US 9,797,587 B2
(45) Date of Patent: Oct. 24, 2017

(54) FLEXIBLE ELECTRICAL CONNECTION OF AN LED-BASED ILLUMINATION DEVICE TO A LIGHT FIXTURE

(71) Applicant: Xicato, Inc., San Jose, CA (US)

(72) Inventors: Gerard Harbers, Sunnyvale, CA (US); Gregory W. Eng, Fremont, CA (US); Christopher R. Reed, San Jose, CA (US); Peter K. Tseng, San Jose, CA (US); John S. Yriberri, San Jose, CA (US)

(73) Assignee: Xicato, Inc., San Jose, CA (US)

( * ) Notice: Subject to any disclaimer, the term of this patent is extended or adjusted under 35 U.S.C. 154(b) by 0 days.

(21) Appl. No.: 15/171,745

(22) Filed: Jun. 2, 2016

(65) Prior Publication Data

US 2016/0356471 A1 Dec. 8, 2016

Related U.S. Application Data

(60) Continuation of application No. 13/956,016, filed on Jul. 31, 2013, now Pat. No. 9,360,168, which is a (Continued)

(51) Int. Cl.
*F21V 23/06* (2006.01)
*H05B 37/02* (2006.01)

(Continued)

(52) U.S. Cl.
CPC ..... *F21V 23/06* (2013.01); *F21K 9/60* (2016.08); *F21K 9/62* (2016.08); *F21V 7/06* (2013.01);

(Continued)

(58) Field of Classification Search
CPC ..... H05B 33/0815; H05B 33/0845; H05B 33/0851; H05B 33/0884; H05B 33/0848;

(Continued)

(56) References Cited

U.S. PATENT DOCUMENTS 5,959,316 A 9/1999 Lowery
6,152,588 A 11/2000 Scifres (Continued)

FOREIGN PATENT DOCUMENTS

CN 1161819 C 8/2004
CN 201028372 Y 2/2008

(Continued)

OTHER PUBLICATIONS

Machine Translation in English of Abstract for EP 1 923 626 A1 visited at <www.espacenet.com> on Feb. 16, 2012, 1 page.

(Continued)

*Primary Examiner* — Tuyet Vo
(74) *Attorney, Agent, or Firm* — Silicon Valley Patent Group LLP

(57) ABSTRACT

An electrical interface module (EIM) is provided between an LED illumination device and a light fixture. The EIM includes an arrangement of contacts that are adapted to be coupled to an LED illumination device and a second arrangement of contacts that are adapted to be coupled to the light fixture and may include a power converter. Additionally, an LED selection module may be included to selectively turn on or off LEDs. A communication port may be included to transmit information associated with the LED illumination device, such as identification, indication of lifetime, flux, etc. The lifetime of the LED illumination device may be measured and communicated, e.g., by an RF signal, IR signal, wired signal or by controlling the light output of the LED illumination device. An optic that is replaceably mounted to the LED illumination device may include, e.g., a flux sensor that is connected to the electrical interface.

8 Claims, 13 Drawing Sheets

Related U.S. Application Data division of application No. 13/089,317, filed on Apr. 19, 2011, now Pat. No. 8,517,562.

(60) Provisional application No. 61/331,225, filed on May 4, 2010.

(51) Int. Cl.

| | |
|---|---|
| ***F21V 23/04*** | (2006.01) |
| ***F21V 29/505*** | (2015.01) |
| ***F21K 9/60*** | (2016.01) |
| ***F21V 29/503*** | (2015.01) |
| ***F21V 29/77*** | (2015.01) |
| ***F21K 9/62*** | (2016.01) |
| ***F21V 7/06*** | (2006.01) |
| ***F21V 7/22*** | (2006.01) |
| *H05B 33/08* | (2006.01) |
| *F21Y 115/10* | (2016.01) |

(52) U.S. Cl.

CPC ..... *F21V 7/22* (2013.01); *F21V 23/04* (2013.01); *F21V 29/503* (2015.01); *F21V 29/505* (2015.01); *F21V 29/773* (2015.01); *H05B 33/0803* (2013.01); *H05B 33/083* (2013.01); *H05B 33/0845* (2013.01); *H05B 33/0893* (2013.01); *H05B 37/0245* (2013.01); *H05B 37/0272* (2013.01); *F21Y 2115/10* (2016.08); *H05B 33/0815* (2013.01); *Y10S 362/80* (2013.01)

(58) Field of Classification Search

CPC ..... H05B 33/0863; H05B 37/03; H05B 41/2828; H05B 41/3921

USPC ..... 315/247, 185 S, 224, 307, 291, 312–324

See application file for complete search history.

(56) References Cited

U.S. PATENT DOCUMENTS

| | | | |
|---|---|---|---|
| 6,348,766 | B1 | 2/2002 | Ohishi et al. |
| 6,351,069 | B1 | 2/2002 | Lowery et al. |
| 6,504,301 | B1 | 1/2003 | Lowery |
| 6,586,882 | B1 | 7/2003 | Harbers |
| 6,600,175 | B1 | 7/2003 | Baretz et al. |
| 6,680,569 | B2 | 1/2004 | Mueller-Mach et al. |
| 6,717,376 | B2 | 4/2004 | Lys et al. |
| 6,812,500 | B2 | 11/2004 | Reeh et al. |
| 7,126,162 | B2 | 10/2006 | Reeh et al. |
| 7,246,919 | B2 | 7/2007 | Porchia et al. |
| 7,250,715 | B2 | 7/2007 | Mueller et al. |
| 7,358,679 | B2 | 4/2008 | Lys et al. |
| 7,479,662 | B2 | 1/2009 | Soules et al. |
| 7,564,180 | B2 | 7/2009 | Brandes |
| 7,587,289 | B1 | 9/2009 | Sivertsen |
| 7,604,378 | B2 | 10/2009 | Wolf et al. |
| 7,614,759 | B2 | 11/2009 | Negley |
| 7,629,621 | B2 | 12/2009 | Reeh et al. |
| 7,902,771 | B2 | 3/2011 | Shteynberg et al. |
| 7,988,336 | B1 | 8/2011 | Harbers et al. |
| 8,050,206 | B2 | 11/2011 | Siann et al. |
| 8,237,381 | B2 | 8/2012 | Harbers et al. |
| 8,517,562 | B2 | 8/2013 | Harbers et al. |
| 2002/0004335 | A1 | 1/2002 | Onizuka |
| 2003/0151909 | A1 | 8/2003 | Sid |
| 2007/0007898 | A1 | 1/2007 | Bruning |
| 2007/0081336 | A1 | 4/2007 | Bierhuizen et al. |
| 2008/0129204 | A1 | 6/2008 | Tsukamoto et al. |
| 2008/0136334 | A1 | 6/2008 | Robinson et al. |
| 2008/0183081 | A1 | 7/2008 | Lys et al. |
| 2010/0259931 | A1 | 10/2010 | Chemel et al. |
| 2011/0057571 | A1 | 3/2011 | Ackermann et al. |
| 2011/0084616 | A1 | 4/2011 | Negley et al. |

FOREIGN PATENT DOCUMENTS

| | | | |
|---|---|---|---|
| CN | 100491810 | C | 5/2009 |
| DE | 10 2007 044567 | A1 | 3/2009 |
| EP | 0 966 183 | A1 | 12/1999 |
| EP | 1 098 550 | A2 | 5/2001 |
| EP | 1 098 550 | A3 | 8/2002 |
| EP | 1 711 038 | A1 | 10/2006 |
| EP | 1 923 626 | A1 | 5/2008 |
| JP | 2001-514432 | | 9/2001 |
| JP | 2002-15805 | T | 1/2002 |
| JP | 2002-157916 | A | 5/2002 |
| JP | 2003-092013 | A | 3/2003 |
| JP | 2006-318773 | A | 11/2006 |
| JP | 2007-48638 | A | 2/2007 |
| JP | 2008-135223 | A | 6/2008 |
| JP | 2009-211845 | A | 9/2009 |
| JP | 2009-238527 | A | 10/2009 |
| JP | 2009-266424 | A | 11/2009 |
| TW | 200612056 | A | 4/2006 |
| TW | 200838358 | A1 | 9/2008 |
| TW | 200944053 | A | 10/2009 |
| TW | 200951345 | A1 | 12/2009 |
| TW | 200952559 | A1 | 12/2009 |
| TW | 201017044 | A | 5/2010 |
| TW | 201431438 | A | 8/2014 |
| WO | WO 2009/112318 | A1 | 9/2009 |
| WO | WO 2009/133505 | A1 | 11/2009 |
| WO | WO 2010/116289 | A1 | 10/2010 |

OTHER PUBLICATIONS

Machine Translation in English of Abstract for DE 10 2007 044567 A1 visited at <www.espacenet.com> on Feb. 16, 2012, 1 page.

Partial International Search Report and Invitation to Pay Additional Fees mailed on Jun. 28, 2011 for International Application No. PCT/US2011/033015 filed on Apr. 19, 2011, eight pages.

International Search Report and Written Opinion mailed on Feb. 8, 2012 for International Application No. PCT/US2011/033015 filed on Apr. 19, 2011, 21 pages.

U.S. Appl. No. 13/089,316, filed Apr. 19, 2011 by Xicato, Inc., 49 pages.

Office Action mailed on Feb. 29, 2012 for U.S. Appl. No. 13/089,316, filed Apr. 19, 2011, 7 pages.

Response to Office Action mailed on May 25, 2012 for U.S. Appl. No. 13/089,316, filed Apr. 19, 2011 by Xicato, Inc., 15 pages.

Notice of Allowance mailed on Jun. 8, 2012 for U.S. Appl. No. 13/089,316, filed Apr. 19, 2011, 7 pages.

U.S. Appl. No. 13/089,317, titled "Flexible Electrical Connection of an LED-Based Illumination Device to a Light Fixture ," filed Apr. 19, 2011 by Xicato, Inc., 50 pages.

Office Action mailed on Nov. 7, 2012 for U.S. Appl. No. 13/089,317, filed Apr. 19, 2011, 8 pages.

Response to Office Action mailed on Feb. 7, 2013 for U.S. Appl. No. 13/089,317, filed Apr. 19, 2011, 9 pages.

Notice of Allowance mailed on May 17, 2013 for U.S. Appl. No. 13/089,317, filed Apr. 19, 2011, 9 pages.

Machine translation in English of Abstract of TW 200944053 filed on Oct. 16, 2009 located at www.espacenet.com on May 2, 2014, 1 page.

Machine translation in English of Abstract of JP 2003-092013 visited at www.espacenet.com on Apr. 19, 2015, 2 pages.

Machine translation in English of Abstract of JP 2006-318773 visited at www.espacenet.com on Apr. 19, 2015, 2 pages.

Machine translation in English of Abstract of JP 2008-135223 visited at www.espacenet.com on Apr. 19, 2015, 2 pages.

Machine translation in English of Abstract of JP 2009-238527 visited at www.espacenet.com on Apr. 19, 2015, 2 pages.

Machine translation in English of Abstract of JP 2009-211845 visited at www.espacenet.com on Aug. 4, 2015, 2 pages.

Office Action mailed from Taiwanese Patent Office on Dec. 7, 2016 for Taiwan Application No. 105108153.

Translation of Office Action mailed from Taiwanese Patent Office on Dec. 7, 2016 for Taiwan Application No. 105108153.

(56) References Cited

OTHER PUBLICATIONS

Office Action mailed from Japanese Patent Office on Dec. 27, 2016 for Japanese Application No. 2016-035128.
Translation of Office Action mailed from Japanese Patent Office on Dec. 27, 2016 for Japanese Application No. 2016-035128.
Machine translation in English of Abstract of JP 2007-48638A visited at www.espacenet.com on Feb. 22, 2017, 2 pages.
Machine translation in English of Abstract of JP 2002-157916A visited at www.espacenet.com on Feb. 22, 2017, 2 pages.
Machine translation in English of Abstract of JP 2001-514432 visited at www.espacenet.com on Feb. 22, 2017, 2 pages.
Machine translation in English of Abstract of JP 2009-266424A visited at www.espacenet.com on Feb. 22, 2017, 2 pages.
Machine translation in English of Abstract of CN 201028372Y visited at www.espacenet.com on Mar. 6, 2017, 1 page.
Machine translation in English of Abstract of TW 200612056A visited at www.espacenet.com on Mar. 6, 2017, 2 pages.
Machine translation in English of Abstract of TW 201017044A visited at www.espacenet.com on Mar. 6, 2017, 1 page.
Machine translation in English of Abstract of CN 1161819C visited at www.espacenet.com on Mar. 6, 2017, 2 pages.
Machine translation in English of Abstract of TW 201431438A visited at www.espacenet.com on Mar. 6, 2017, 2 pages.

FLEXIBLE ELECTRICAL CONNECTION OF AN LED-BASED ILLUMINATION DEVICE TO A LIGHT FIXTURE

CROSS REFERENCE TO RELATED APPLICATIONS

This application is a continuation of U.S. application Ser. No. 13/956,016, filed Jul. 31, 2013, which is a divisional of U.S. application Ser. No. 13/089,317, filed Apr. 19, 2011, granted as U.S. Pat. No. 8,517,562, and issued on Aug. 27, 2013, which, in turn, claims the benefit of U.S. Provisional Application No. 61/331,225, filed May 4, 2010, both of which are incorporated by reference herein in their entireties.

TECHNICAL FIELD

The described embodiments relate to illumination devices that include Light Emitting Diodes (LEDs).

BACKGROUND INFORMATION

The use of LEDs in general lighting is becoming more desirable and more prevalent. Illumination devices that include LEDs typically require large amounts of heat sinking and specific power requirements. Consequently, many such illumination devices must be mounted to light fixtures that include heat sinks and provide the necessary power. The typically electrical connection of such an LED illumination device to a light fixture, unfortunately, is not user friendly. Consequently, improvements are desired.

SUMMARY

In accordance with one embodiment, an electrical interface module is provided between an LED illumination device and a light fixture. The electrical interface module includes an arrangement of electrical contact surfaces that are adapted to be coupled to an LED illumination device and a second arrangement of electrical contact surfaces that are adapted to be coupled to the light fixture. The electrical contact surfaces may be adapted to be electrically coupleable to different configurations of contact surfaces on different LED illumination devices. The electrical interface module may include a power converter that is coupled to the LED illumination device through the electrical contact surfaces. Additionally, an LED selection module that uses switching elements to selectively turn on or off LEDs in the LED illumination device. A communication port that is controlled by a processor may be included to transmit information associated with the LED illumination device, such as identification, indication of lifetime, flux, etc. The lifetime of the LED illumination device may be measured by accumulating the number of cycles generated by an electronic circuit and communicated, e.g., by an RF signal, IR signal, wired signal or by controlling the light output of the LED illumination device. Additionally, an optic that is replaceably mounted to the LED illumination device may include, e.g., a flux sensor that is connected to the electrical interface.

DETAILED DESCRIPTION

Reference will now be made in detail to background examples and some embodiments of the invention, examples of which are illustrated in the accompanying drawings.

Figure 1:
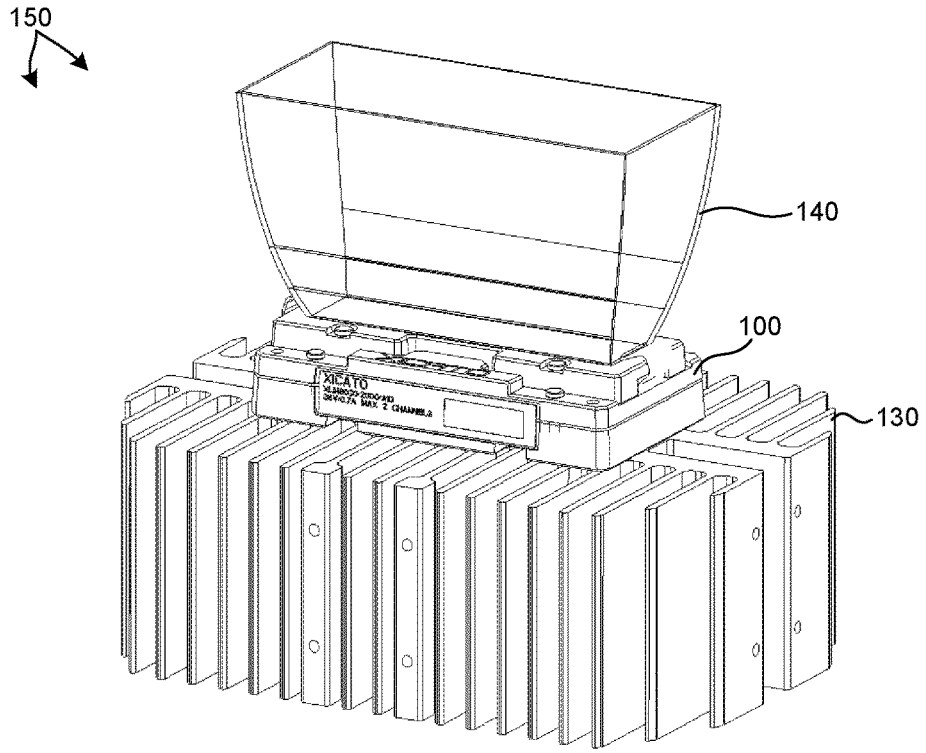
FIGS. 1-2 illustrate two exemplary luminaires, including an illumination device, reflector, and light fixture.
Figure 2:
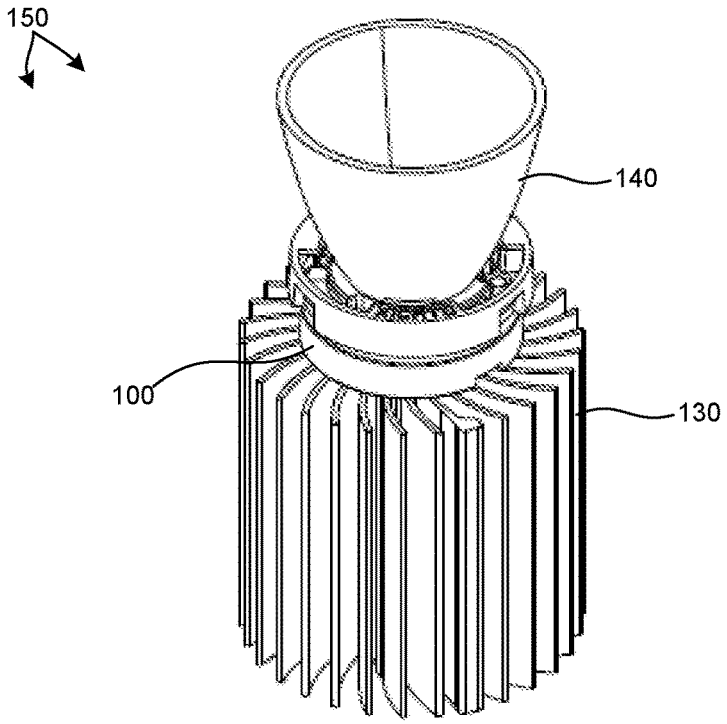

FIGS. 1-2 illustrate two exemplary luminaires. The luminaire illustrated in FIG. 1 includes an illumination device 100 with a rectangular form factor. The luminaire illustrated in FIG. 2 includes an illumination device 100 with a circular form factor. These examples are for illustrative purposes. Examples of illumination devices of general polygonal and elliptical shapes may also be contemplated. Luminaire 150 includes illumination device 100, reflector 140, and light fixture 130. As depicted, light fixture 130 is a heat sink, and thus, may sometimes be referred as heat sink 130. However, light fixture 130 may include other structural and decorative elements (not shown). Reflector 140 is mounted to illumination device 100 to collimate or deflect light emitted from illumination device 100. The reflector 140 may be made from a thermally conductive material, such as a material that includes aluminum or copper and may be thermally coupled to illumination device 100. Heat flows by conduction through illumination device 100 and the thermally conductive reflector 140. Heat also flows via thermal convection over the reflector 140. Reflector 140 may be a compound parabolic concentrator, where the concentrator is constructed of or coated with a highly reflecting material. Compound parabolic concentrators tend to be tall, but they often are used in a reduced length form, which increases the beam angle. An advantage of this configuration is that no additional diffusers are required to homogenize the light, which increases the throughput efficiency. Optical elements, such as a diffuser or reflector 140 may be removably coupled to illumination device 100, e.g., by means of threads, a clamp, a twist-lock mechanism, or other appropriate arrangement.

Illumination device 100 is mounted to light fixture 130. As depicted in FIGS. 1 and 2, illumination device 100 is mounted to heat sink 130. Heat sink 130 may be made from a thermally conductive material, such as a material that includes aluminum or copper and may be thermally coupled to illumination device 100. Heat flows by conduction through illumination device 100 and the thermally conductive heat sink 130. Heat also flows via thermal convection over heat sink 130. Illumination device 100 may be attached to heat sink 130 by way of screw threads to clamp the illumination device 100 to the heat sink 130. To facilitate easy removal and replacement of illumination device 100, illumination device 100 may be removably coupled to heat sink 130, e.g., by means of a clamp mechanism, a twist-lock mechanism, or other appropriate arrangement. Illumination device 100 includes at least one thermally conductive surface that is thermally coupled to heat sink 130, e.g., directly or using thermal grease, thermal tape, thermal pads, or thermal epoxy. For adequate cooling of the LEDs, a thermal contact area of at least 50 square millimeters, but preferably 100 square millimeters should be used per one watt of electrical energy flow into the LEDs on the board. For example, in the case when 20 LEDs are used, a 1000 to 2000 square millimeter heatsink contact area should be used. Using a larger heat sink 130 may permit the LEDs 102 to be driven at higher power, and also allows for different heat sink designs. For example, some designs may exhibit a cooling capacity that is less dependent on the orientation of the heat sink. In addition, fans or other solutions for forced cooling may be used to remove the heat from the device. The bottom heat sink may include an aperture so that electrical connections can be made to the illumination device 100.

Figure 3A:
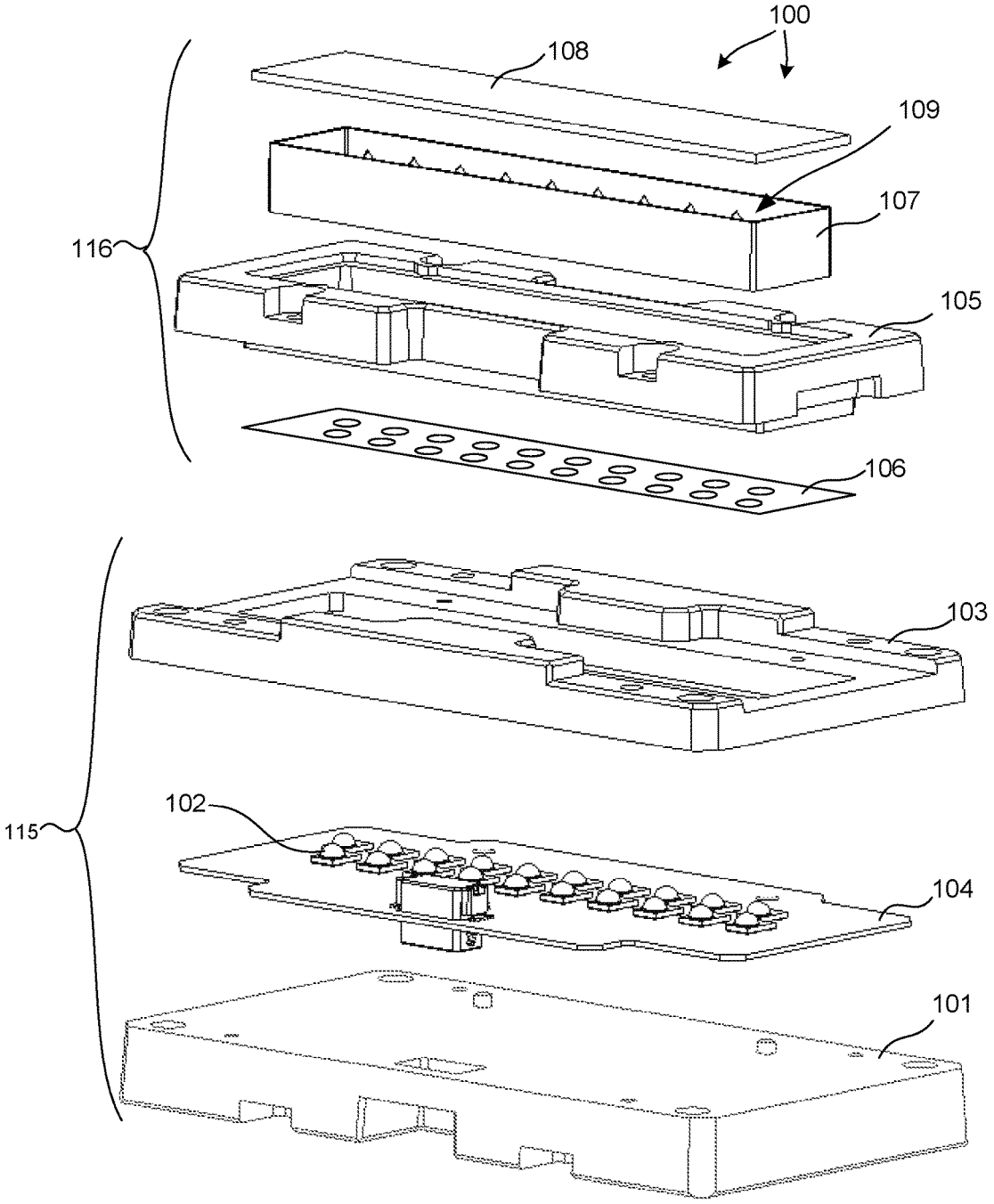
FIG. 3A shows an exploded view illustrating components of LED based illumination device as depicted in FIG. 1.
Figure 3B:
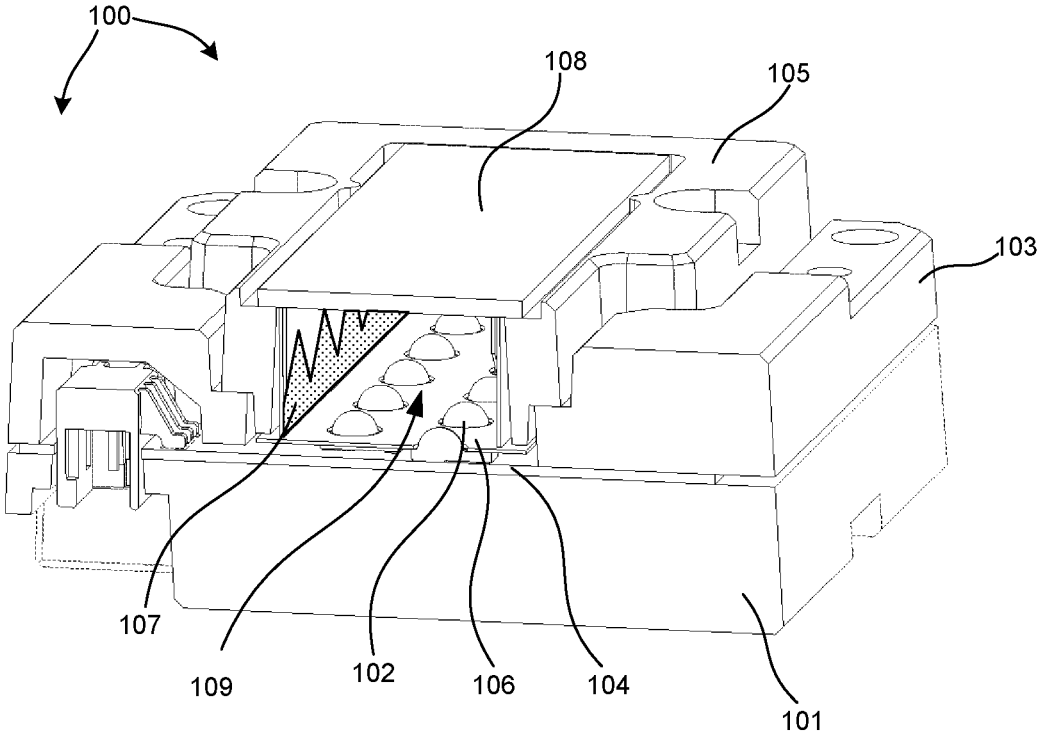
FIG. 3B illustrates a perspective, cross-sectional view of LED based illumination device as depicted in FIG. 1.

FIG. 3A shows an exploded view illustrating components of LED illumination device 100 as depicted in FIG. 1. It should be understood that as defined herein an LED illumination device is not an LED, but is an LED light source or fixture or component part of an LED light source or fixture. LED illumination device 100 includes one or more LED die or packaged LEDs and a mounting board to which LED die or packaged LEDs are attached. FIG. 3B illustrates a perspective, cross-sectional view of LED illumination device 100 as depicted in FIG. 1. LED illumination device 100 includes one or more solid state light emitting elements, such as light emitting diodes (LEDs) 102, mounted on mounting board 104. Mounting board 104 is attached to mounting base 101 and secured in position by mounting board retaining ring 103. Together, mounting board 104 populated by LEDs 102 and mounting board retaining ring 103 comprise light source sub-assembly 115. Light source sub-assembly 115 is operable to convert electrical energy into light using LEDs 102. The light emitted from light source sub-assembly 115 is directed to light conversion sub-assembly 116 for color mixing and color conversion. Light conversion sub-assembly 116 includes cavity body 105 and output window 108, and optionally includes either or both bottom reflector insert 106 and sidewall insert 107. Output window 108 is fixed to the top of cavity body 105. Cavity body 105 includes interior sidewalls such that the interior sidewalls direct light from the LEDs 102 to the output window 108 when cavity body 105 is mounted over light source sub-assembly 115. Bottom reflector insert 106 may optionally be placed over mounting board 104. Bottom reflector insert 106 includes holes such that the light emitting portion of each LED 102 is not blocked by bottom reflector insert 106. Sidewall insert 107 may optionally be placed inside cavity body 105 such that the interior surfaces of sidewall insert 107 direct light from the LEDs 102 to the output window when cavity body 105 is mounted over light source sub-assembly 115. Although as depicted, the interior sidewalls of cavity body 105 are rectangular in shape as viewed from the top of illumination device 100, other shapes may be contemplated (e.g. clover shaped or polygonal). In addition, the interior sidewalls of cavity body 105 may taper outward from mounting board 104 to output window 108, rather than perpendicular to output window 108 as depicted.

In this embodiment, the sidewall insert 107, output window 108, and bottom reflector insert 106 disposed on mounting board 104 define a light mixing cavity 109 in the LED illumination device 100 in which a portion of light from the LEDs 102 is reflected until it exits through output window 108. Reflecting the light within the cavity 109 prior to exiting the output window 108 has the effect of mixing the light and providing a more uniform distribution of the light that is emitted from the LED illumination device 100. Portions of sidewall insert 107 may be coated with a wavelength converting material. Furthermore, portions of output window 108 may be coated with the same or a different wavelength converting material. In addition, portions of bottom reflector insert 106 may be coated with the same or a different wavelength converting material. The photo converting properties of these materials in combination with the mixing of light within cavity 109 results in a color converted light output by output window 108. By tuning the chemical properties of the wavelength converting materials and the geometric properties of the coatings on the interior surfaces of cavity 109, specific color properties of light output by output window 108 may be specified, e.g. color point, color temperature, and color rendering index (CRI).

For purposes of this patent document, a wavelength converting material is any single chemical compound or mixture of different chemical compounds that performs a color conversion function, e.g. absorbs light of one peak wavelength and emits light at another peak wavelength.

Cavity 109 may be filled with a non-solid material, such as air or an inert gas, so that the LEDs 102 emit light into the non-solid material. By way of example, the cavity may be hermetically sealed and Argon gas used to fill the cavity. Alternatively, Nitrogen may be used. In other embodiments, cavity 109 may be filled with a solid encapsulent material. By way of example, silicone may be used to fill the cavity.

The LEDs 102 can emit different or the same colors, either by direct emission or by phosphor conversion, e.g., where phosphor layers are applied to the LEDs as part of the LED package. Thus, the illumination device 100 may use any combination of colored LEDs 102, such as red, green, blue, amber, or cyan, or the LEDs 102 may all produce the same color light or may all produce white light. For example, the LEDs 102 may all emit either blue or UV light. When used in combination with phosphors (or other wavelength conversion means), which may be, e.g., in or on the output window 108, applied to the sidewalls of cavity body 105, or applied to other components placed inside the cavity (not shown), such that the output light of the illumination device 100 has the color as desired.

The mounting board 104 provides electrical connections to the attached LEDs 102 to a power supply (not shown). In one embodiment, the LEDs 102 are packaged LEDs, such as the Luxeon Rebel manufactured by Philips Lumileds Lighting. Other types of packaged LEDs may also be used, such as those manufactured by OSRAM (Ostar package), Luminus Devices (USA), Cree (USA), Nichia (Japan), or Tridonic (Austria). As defined herein, a packaged LED is an assembly of one or more LED die that contains electrical connections, such as wire bond connections or stud bumps, and possibly includes an optical element and thermal, mechanical, and electrical interfaces. The LEDs 102 may include a lens over the LED chips. Alternatively, LEDs without a lens may be used. LEDs without lenses may include protective layers, which may include phosphors. The phosphors can be applied as a dispersion in a binder, or applied as a separate plate. Each LED 102 includes at least one LED chip or die, which may be mounted on a submount. The LED chip typically has a size about 1 mm by 1 mm by 0.5 mm, but these dimensions may vary. In some embodiments, the LEDs 102 may include multiple chips. The multiple chips can emit light similar or different colors, e.g., red, green, and blue. The LEDs 102 may emit polarized light or non-polarized light and LED based illumination device 100 may use any combination of polarized or non-polarized LEDs. In some embodiments, LEDs 102 emit either blue or UV light because of the efficiency of LEDs emitting in these wavelength ranges. In addition, different phosphor layers may be applied on different chips on the same submount. The submount may be ceramic or other appropriate material. The submount typically includes electrical contact pads on a bottom surface that are coupled to contacts on the mounting board 104. Alternatively, electrical bond wires may be used to electrically connect the chips to a mounting board. Along with electrical contact pads, the LEDs 102 may include thermal contact areas on the bottom surface of the submount through which heat generated by the LED chips can be extracted. The thermal contact areas are coupled to heat spreading layers on the mounting board 104. Heat spreading layers may be disposed on any of the top, bottom, or intermediate layers of mounting board 104. Heat spreading layers may be connected by vias that connect any of the top, bottom, and intermediate heat spreading layers.

In some embodiments, the mounting board 104 conducts heat generated by the LEDs 102 to the sides of the board 104 and the bottom of the board 104. In one example, the bottom of mounting board 104 may be thermally coupled to a heat sink 130 (shown in FIGS. 1 and 2) via mounting base 101. In other examples, mounting board 104 may be directly coupled to a heat sink, or a lighting fixture and/or other mechanisms to dissipate the heat, such as a fan. In some embodiments, the mounting board 104 conducts heat to a heat sink thermally coupled to the top of the board 104. For example, mounting board retaining ring 103 and cavity body 105 may conduct heat away from the top surface of mounting board 104. Mounting board 104 may be an FR4 board, e.g., that is 0.5 mm thick, with relatively thick copper layers, e.g., 30 μm to 100 μm, on the top and bottom surfaces that serve as thermal contact areas. In other examples, the board 104 may be a metal core printed circuit board (PCB) or a ceramic submount with appropriate electrical connections. Other types of boards may be used, such as those made of alumina (aluminum oxide in ceramic form), or aluminum nitride (also in ceramic form).

Mounting board 104 includes electrical pads to which the electrical pads on the LEDs 102 are connected. The electrical pads are electrically connected by a metal, e.g., copper, trace to a contact, to which a wire, bridge or other external electrical source is connected. In some embodiments, the electrical pads may be vias through the board 104 and the electrical connection is made on the opposite side, i.e., the bottom, of the board. Mounting board 104, as illustrated, is rectangular in dimension. LEDs 102 mounted to mounting board 104 may be arranged in different configurations on rectangular mounting board 104. In one example LEDs 102 are aligned in rows extending in the length dimension and in columns extending in the width dimension of mounting board 104. In another example, LEDs 102 are arranged in a hexagonally closely packed structure. In such an arrangement each LED is equidistant from each of its immediate neighbors. Such an arrangement is desirable to increase the uniformity and efficiency of light emitted from the light source sub-assembly 115.

Figure 4:
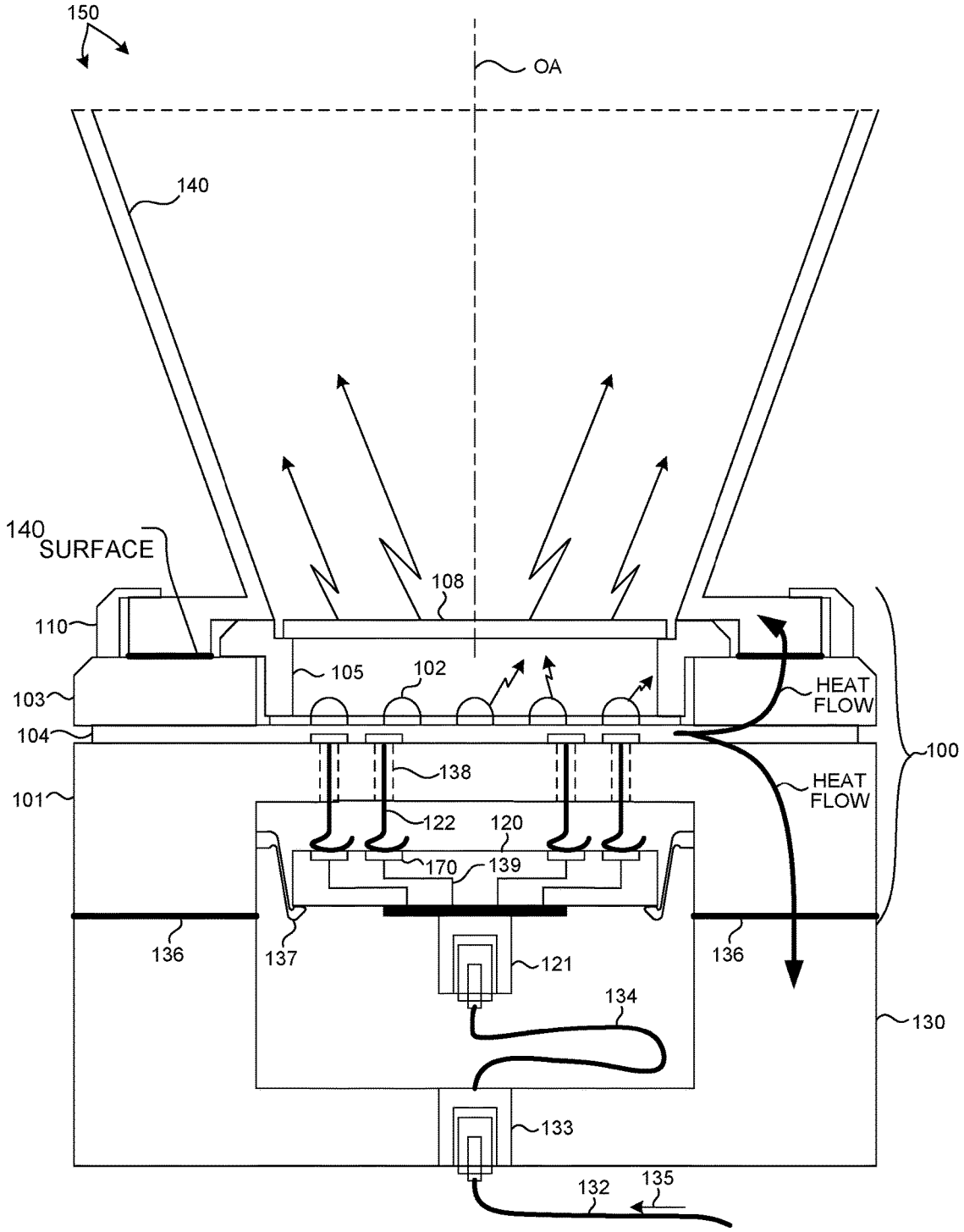
FIG. 4 illustrates a cut-away view of luminaire as depicted in FIG. 2, with an electrical interface module coupled between the LED illumination device and the light fixture.

FIG. 4 illustrates a cut-away view of luminaire 150 as depicted in FIG. 2. Reflector 140 is removably coupled to illumination device 100. Reflector 140 is coupled to illumination device 100 by a twist-lock mechanism. Reflector 140 is aligned with illumination device 100 by bringing reflector 140 into contact with illumination device 100 through openings in reflector retaining ring 110. Reflector 140 is coupled to illumination device 100 by rotating reflector 140 about optical axis (OA) to an engaged position. In the engaged position, the reflector 140 is captured between mounting board retaining ring 103 and reflector retaining ring 110. In the engaged position, an interface pressure may be generated between mating thermal interface surface $\mathbf{140}_{surface}$ of reflector 140 and mounting board retaining ring 103. In this manner, heat generated by LEDs 102 may be conducted via mounting board 104, through mounting board retaining ring 103, through interface $\mathbf{140}_{surface}$, and into reflector 140. In addition, a plurality of electrical connections may be formed between reflector 140 and retaining ring 103.

Illumination device 100 includes an electrical interface module (EIM) 120. As illustrated, EIM 120 may be removably attached to illumination device 100 by retaining clips 137. In other embodiments, EIM 120 may be removably attached to illumination device 100 by an electrical connector coupling EIM 120 to mounting board 104. EIM 120 may also be coupled to illumination device 100 by other fastening means, e.g. screw fasteners, rivets, or snap-fit connectors. As depicted EIM 120 is positioned within a cavity of illumination device 100. In this manner, EIM 120 is contained within illumination device 100 and is accessible from the bottom side of illumination device 100. In other embodiments, EIM 120 may be at least partially positioned within light fixture 130. The EIM 120 communicates electrical signals from light fixture 130 to illumination device 100. Electrical conductors 132 are coupled to light fixture 130 at electrical connector 133. By way of example, electrical connector 133 may be a registered jack (RJ) connector commonly used in network communications applications. In other examples, electrical conductors 132 may be coupled to light fixture 130 by screws or clamps. In other examples, electrical conductors 132 may be coupled to light fixture 130 by a removable slip-fit electrical connector. Connector 133 is coupled to conductors 134. Conductors 134 are removably coupled to electrical connector 121 mounted to EIM 120. Similarly, electrical connector 121 may be a RJ connector or any suitable removable electrical connector. Connector 121 is fixedly coupled to EIM 120. Electrical signals 135 are communicated over conductors 132 through electrical connector 133, over conductors 134, through electrical connector 121 to EIM 120. Electrical signals 135 may include power signals and data signals. EIM 120 routes electrical signals 135 from electrical connector 121 to appropriate electrical contact pads on EIM 120. For example, conductor 139 within EIM 120 may couple connector 121 to electrical contact pad 170 on the top surface of EIM 120. Alternatively, connector 121 may be mounted on the same side of EIM 120 as the electrical contact pads 170, and thus, a surface conductor may couple connector 121 to the electrical contact pads 170. As illustrated, spring pin 122 removably couples electrical contact pad 170 to mounting board 104 through an aperture 138 in mounting base 101. Spring pins couple contact pads disposed on the top surface of EIM 120 to contact pads of mounting board 104. In this manner, electrical signals are communicated from EIM 120 to mounting board 104. Mounting board 104 includes conductors to appropriately couple LEDs 102 to the contact pads of mounting board 104. In this manner, electrical signals are communicated from mounting board 104 to appropriate LEDs 102 to generate light. EIM 120 may be constructed from a printed circuit board (PCB), a metal core PCB, a ceramic substrate, or a semiconductor substrate. Other types of boards may be used, such as those made of alumina (aluminum oxide in ceramic form), or aluminum nitride (also in ceramic form). EIM 120 may be a constructed as a plastic part including a plurality of insert molded metal conductors.

Mounting base 101 is replaceably coupled to light fixture 130. In the illustrated example, light fixture 130 acts as a heat sink. Mounting base 101 and light fixture 130 are coupled together at a thermal interface 136. At the thermal interface 136, a portion of mounting base 101 and a portion of light fixture 130 are brought into contact as illumination device 100 is coupled to light fixture 130. In this manner, heat generated by LEDs 102 may be conducted via mounting board 104, through mounting base 101, through interface 136, and into light fixture 130.

To remove and replace illumination device 100, illumination device 100 is decoupled from light fixture 130 and electrical connector 121 is disconnected. In one example, conductors 134 includes sufficient length to allow sufficient separation between illumination device 100 and light fixture 130 to allow an operator to reach between fixture 130 and illumination device 100 to disconnect connector 121. In another example, connector 121 may be arranged such that a displacement between illumination device 100 from light fixture 130 operates to disconnect connector 121. In another example, conductors 134 are wound around a spring-loaded reel. In this manner, conductors 134 may be extended by unwinding from the reel to allow for connection or disconnection of connector 121, and then conductors 134 may be retracted by winding conductors 134 onto the reel by action of spring-loaded reel.

Figure 5A:
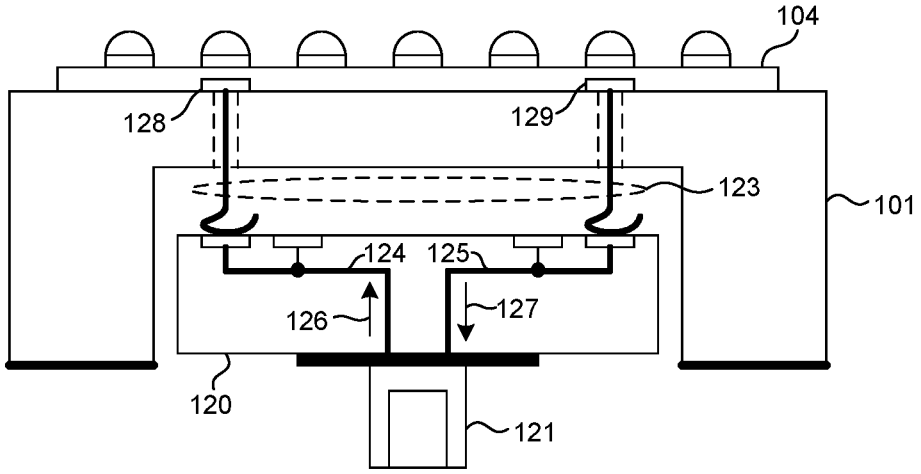
FIGS. 5A-5B illustrate two different configurations of the electrical interface module.
Figure 5B:
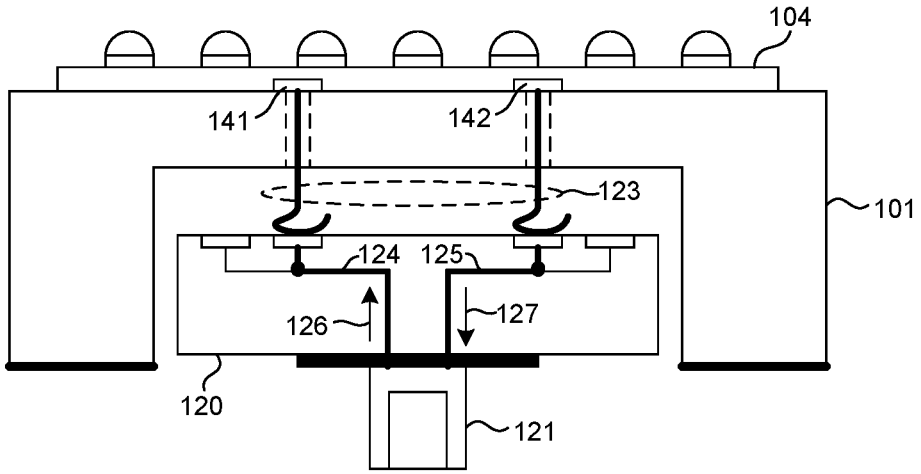

FIGS. 5A-B illustrate EIM 120 coupled to mounting board 104 in two different configurations. As illustrated in FIG. 5A, mounting board 104 is coupled to EIM 120 by spring pin assembly 123 in a first configuration. EIM 120 includes conductors 124 and 125. Electrical signal 126 is communicated from connector 121, over conductor 124, over spring pin assembly 123 in a first configuration to terminal 128 of mounting board 104. Electrical signal 127 is communicated from terminal 129 of mounting board 104, over spring pin assembly 123 in a first configuration, over conductor 125, to connector 121. As illustrated in FIG. 5B, mounting board 104 is coupled to EIM 120 by spring pin assembly 123 in a second configuration. Electrical signal 126 is communicated from connector 121, over conductor 124, over spring pin assembly 123 in the second configuration to terminal 141 of mounting board 104. Electrical signal 127 is communicated from terminal 142 of mounting board 104, over spring pin assembly 123 in a second configuration, over conductor 125, to connector 121. As illustrated in FIGS. 5A-B, the same EIM 120 may communicate electrical signals to mounting boards with different terminal locations. Conductors 124 and 125 are configured such that the same signal from connector 121 can be communicated between multiple terminals at the interface between EIM 120 and spring pin assembly 123. Different configurations of spring pin assembly 123 can be utilized to communicate signals to different terminal locations of mounting board 104. In this manner, the same connector 121 and EIM 120 may be utilized to address a variety of different terminal configurations of mounting boards within illumination device 100.

Figure 6A:
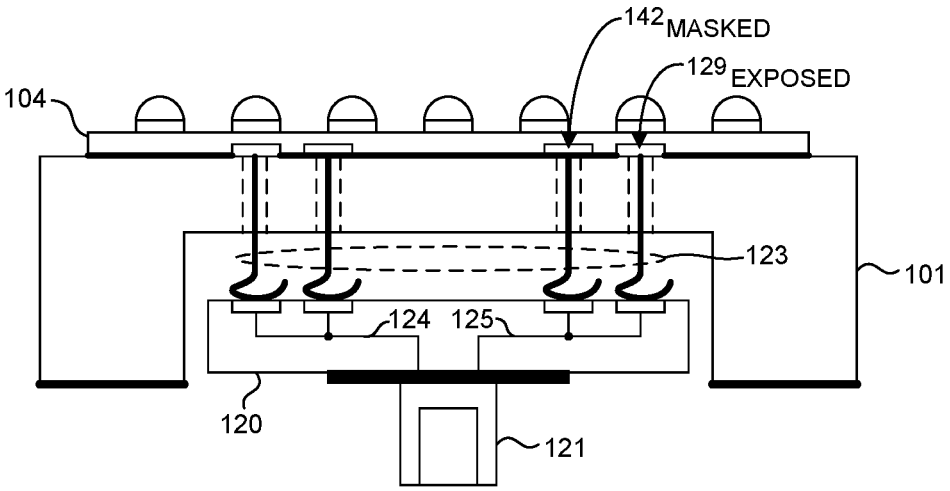
FIGS. 6A-6B illustrate selectively masking and exposing terminal locations on the electrical interface module.
Figure 6B:
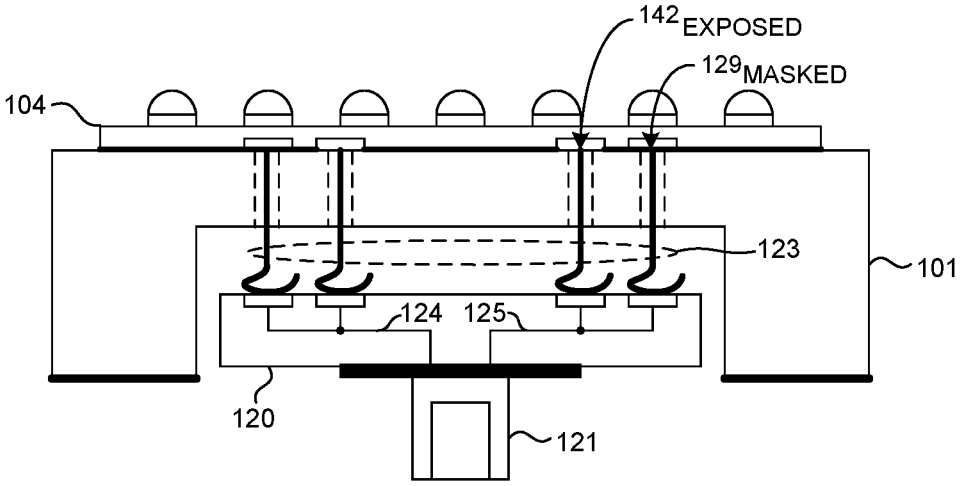

In other embodiments, the same spring pin assembly 123, connector 121, and EIM 120 may be utilized to address a variety of different terminal configurations of mounting boards within illumination device 100. As illustrated in FIGS. 6A-B, by selectively masking and exposing terminal locations on the surface of mounting board 104, different terminals of mounting board 104 may be coupled to spring pin assembly 123. As discussed above with respect to FIGS. 5A and 5B, EIM 120 may supply electrical signals to mounting boards of different physical configurations. Conductors 124 and 125 are configured such that a signal from connector 121 can be communicated to multiple terminals at the interface between EIM 120 and spring pin assembly 123. In this manner, the same connector 121, EIM 120, and spring pin assembly 123 may be utilized to address a variety of different terminal configurations of mounting boards within illumination device 100 by selectively masking and exposing terminal locations on the surface of mounting board 104, illustrated in FIG. 6A as masked terminal $\mathbf{142}_{MASKED}$ and exposed terminal $\mathbf{129}_{EXPOSED}$ and illustrated in FIG. 6B exposed terminal $\mathbf{142}_{EXPOSED}$ and masked terminal $\mathbf{129}_{MASKED}$.

Figure 7:
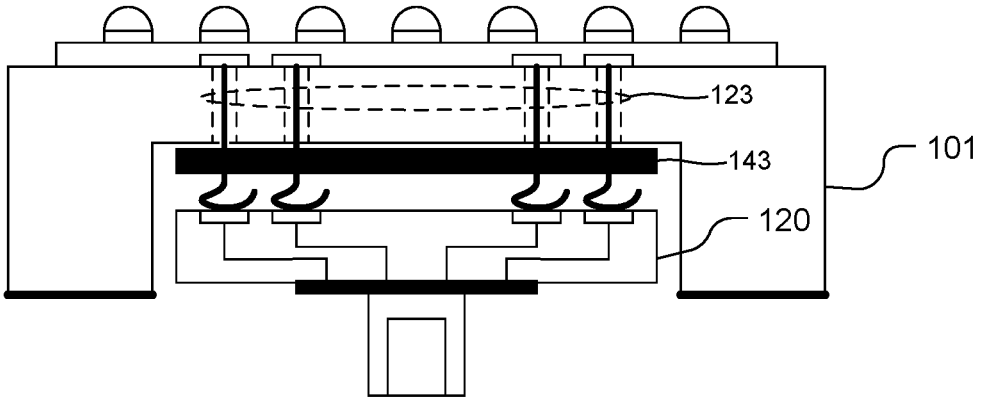
FIG. 7 illustrates a lead frame that may be used to position a plurality of spring pins for contact with the electrical interface module.
Figure 8:
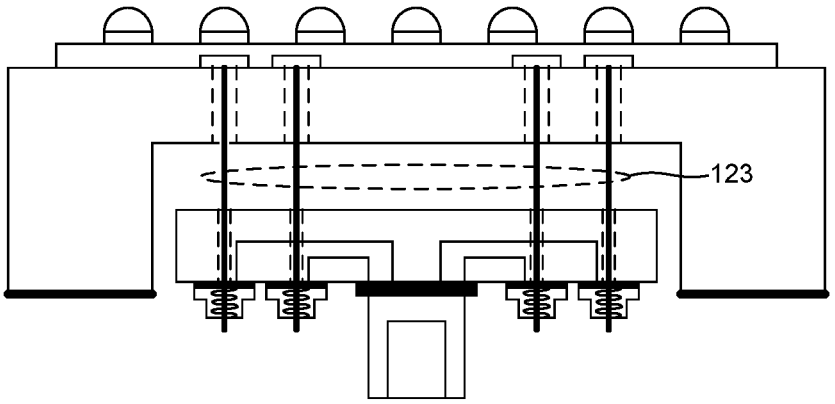
FIG. 8 illustrates an embodiment of the spring pins that may be used to contact the electrical interface module.

As depicted in FIGS. 4 and 6A, 6B, spring pin assembly 123 includes a plurality of spring pins. As depicted in FIG. 7, the plurality of spring pins in the spring pin assembly 123 may be positioned with respect to one another by a lead frame 143. In other embodiments, the plurality of spring pins may be molded in with frame 143 to generate molded-in lead frame 143. The lead frame 143 may be connected to EIM 120 or to mounting base 101. Spring pin 122 may be shaped such that the spring pin 122 is compliant along the axis of the pin, as depicted in FIG. 4. For example, pin 122 includes a hook shape at one end that serves to make contact with a terminal, but also serves to displace when a force is applied between the two ends of the pin. The compliance of each pin of spring pin assembly 123 ensures that each pin makes contact with terminals on each end of each pin when EIM 120 and mounting board 104 are brought into electrical contact. In other embodiments, spring pin 122 may include multiple parts to achieve compliance along the axial direction of pin 122 as illustrated in FIG. 8. Electrical contact between each spring pin and EIM 120 may be made at the top surface of EIM 120, but may also be made at the bottom surface.

Figure 9A:
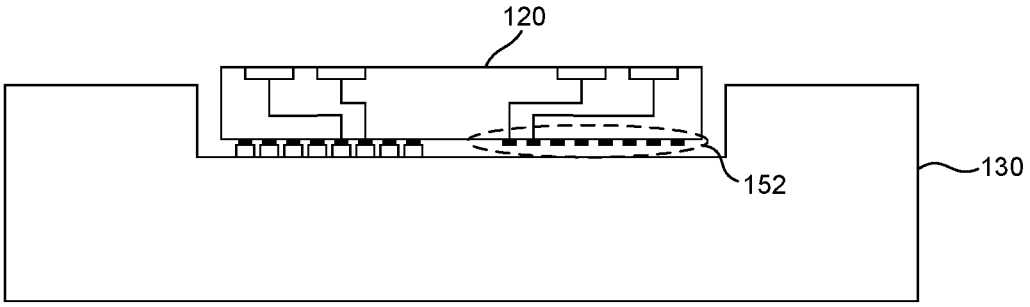
FIGS. 9A-9C illustrate a plurality of radially spaced electrical contacts that may be used with the electrical interface module.
Figure 9B:
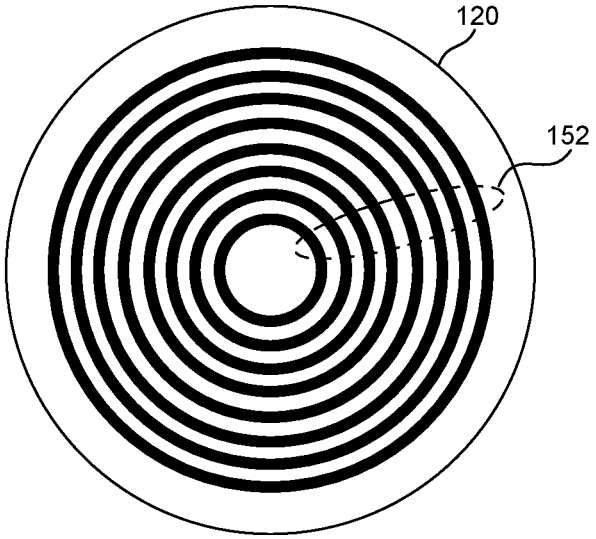
Figure 9C:
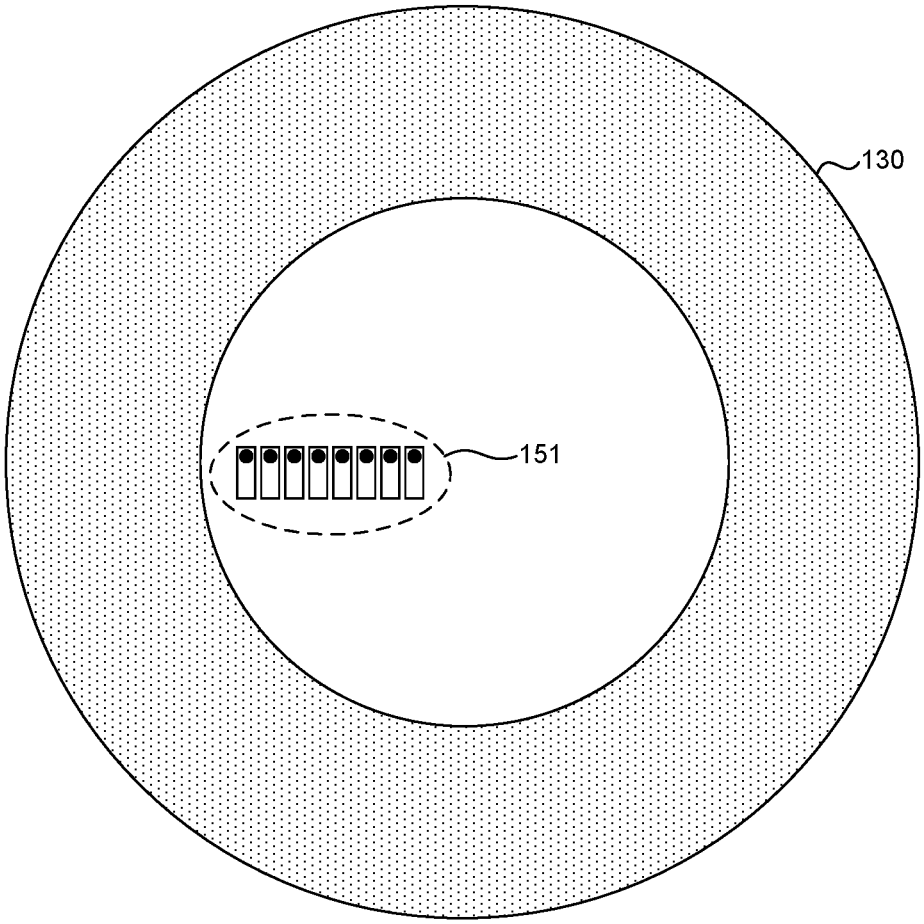

Although, as depicted in FIG. 4, a RJ connector is employed to couple light fixture 130 to EIM 120, other connector configurations may be contemplated. In some embodiments, a slip connector may be employed to electrically couple EIM 120 to fixture 130. In other embodiments, a plurality of radially spaced electrical contacts may be employed. For example, FIGS. 9A-C illustrate an embodiment that employs a plurality of radially spaced electrical contacts. FIG. 9A illustrates a side view of light fixture 130 and EIM 120. FIG. 9B illustrates a bottom view of EIM 120. EIM 120 includes a plurality of radially spaced electrical contacts 152. As depicted, electrical contacts 152 are circular shaped, but other elliptical or polygonal shapes may be contemplated. When EIM 120 is coupled to light fixture 130, contacts 152 align and make contact with spring contacts 151 of light fixture 130. FIG. 9C illustrates a top view of light fixture 130 including spring contacts 151. In the depicted configuration, EIM 120 may be aligned with light fixture 130 and make electrical contact with fixture 130 regardless of the orientation of EIM 120 with respect to fixture 130. In other examples, an alignment feature may be utilized to align EIM 120 with light fixture 130 in a predetermined orientation.

Figure 10:
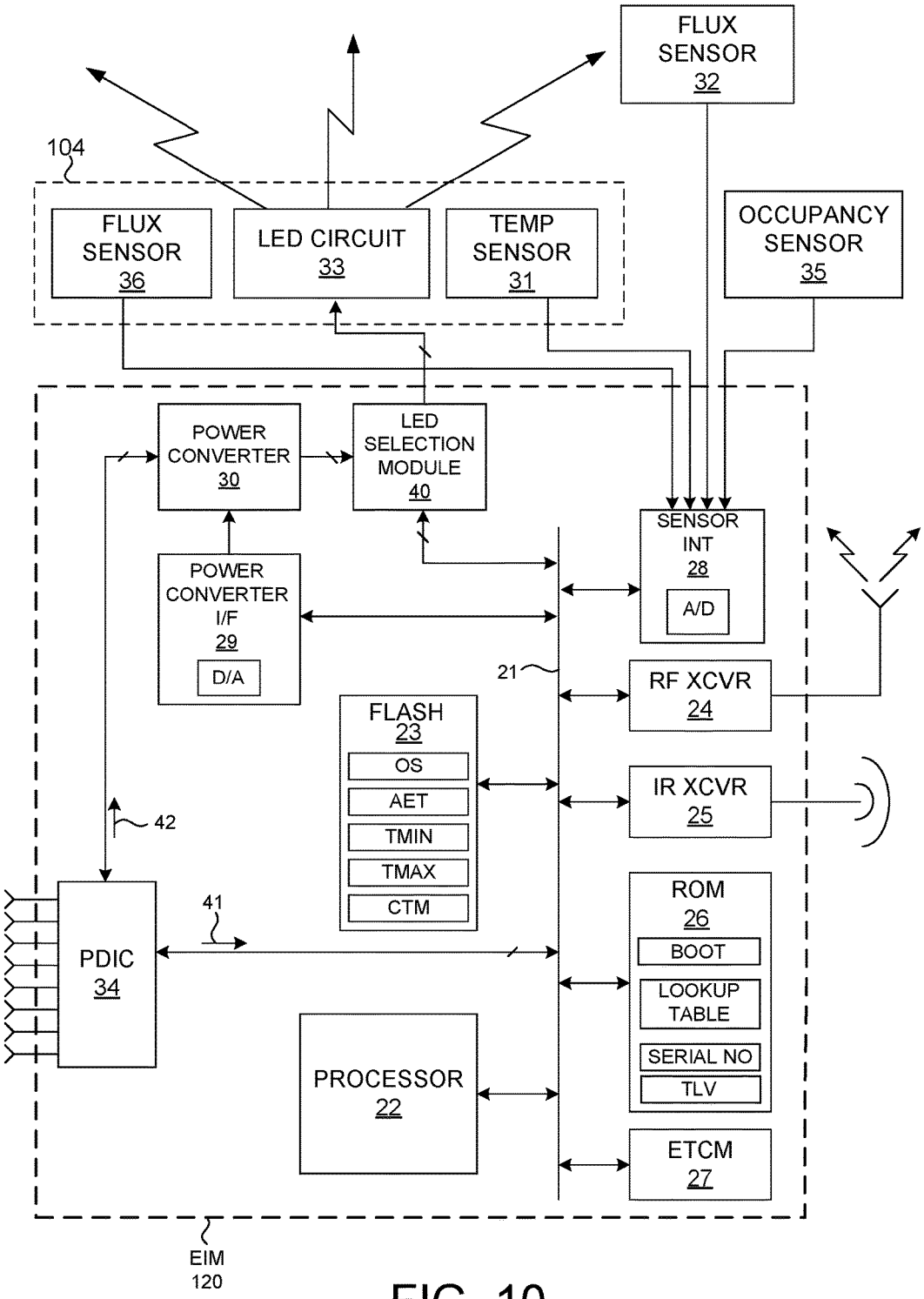
FIG. 10 is a schematic diagram illustrative of the electrical interface module in greater detail.

FIG. 10 is a schematic diagram illustrative of EIM 120 in greater detail. In the depicted embodiment, EIM 120 includes bus 21, powered device interface controller (PDIC) 34, processor 22, elapsed time counter module (ETCM) 27, an amount of non-volatile memory 26 (e.g. EPROM), an amount of non-volatile memory 23 (e.g. flash memory), infrared transceiver 25, RF transceiver 24, sensor interface 28, power converter interface 29, power converter 30, and LED selection module 40. LED mounting board 104 is coupled to EIM 120. LED mounting board 104 includes flux sensor 36, LED circuitry 33 including LEDs 102, and temperature sensor 31. EIM 120 is also coupled to flux sensor 32 and occupancy sensor 35 mounted to light fixture 130. In some embodiments, flux sensor 32 and occupancy sensor 35 may be mounted to an optic, such as reflector 140 as discussed with respect to FIG. 14. In some embodiments, an occupancy sensor may also be mounted to mounting board 104. In some embodiments, any of an accelerometer, a pressure sensor, and a humidity sensor may be mounted to mounting board 104. For example, an accelerometer may be added to detect the orientation of illumination device 100 with respect to the gravitational field. In another example, the accelerometer may provide a measure of vibration present in the operating environment of illumination device 100. In another example, a humidity sensor may be added to provide a measure of the moisture content of the operating environment of illumination device 100. For example, if illumination device 100 is sealed to reliably operate in wet conditions, the humidity sensor may be employed to detect a failure of the seal and contamination of the illumination device. In another example, a pressure sensor may be employed to provide a measure of the pressure of the operating environment of illumination device 100. For example, if illumination device 100 is sealed and evacuated, or alternatively, sealed and pressurized, the pressure sensor may be employed to detect a failure of the seal.

PDIC 34 is coupled to connector 121 and receives electrical signals 135 over conductors 134. In one example, PDIC 34 is a device complying with the IEEE 802.3 protocol for transmitting power and data signals over multi-conductor cabling (e.g. category 5e cable). PDIC 34 separates incoming signals 135 into data signals 41 communicated to bus 21 and power signals 42 communicated to power converter 30 in accordance with the IEEE 802.3 protocol. Power converter 30 operates to perform power conversion to generate electrical signals to drive one or more LED circuits of circuitry 33. In some embodiments, power converter 30 operates in a current control mode to supply a controlled amount of current to LED circuits within a predefined voltage range. In some embodiments, power converter 30 is a direct current to direct current (DC-DC) power converter. In these embodiments, power signals 42 may have a nominal voltage of 48 volts in accordance with the IEEE 802.3 standard. Power signals 42 are stepped down in voltage by DC-DC power converter 30 to voltage levels that meet the voltage requirements of each LED circuit coupled to DC-DC converter 30.

In some other embodiments, power converter 30 is an alternating current to direct current (AC-DC) power converter. In yet other embodiments, power converter 30 is an alternating current to alternating current (AC-AC) power converter. In embodiments employing AC-AC power converter 30, LEDs 102 mounted to mounting board 104 generate light from AC electrical signals. Power converter 30 may be single channel or multi-channel. Each channel of power converter 30 supplies electrical power to one LED circuit of series connected LEDs. In one embodiment power converter 30 operates in a constant current mode. This is particularly useful where LEDs are electrically connected in series. In some other embodiments, power converter 30 may operate as a constant voltage source. This may be particularly useful where LEDs are electrically connected in parallel.

As depicted, power converter 30 is coupled to power converter interface 29. In this embodiment, power converter interface 29 includes a digital to analog (D/A) capability. Digital commands may be generated by operation of processor 22 and communicated to power converter interface 29 over bus 21. Interface 29 converts the digital command signals to analog signals and communicates the resulting analog signals to power converter 30. Power converter 30 adjusts the current communicated to coupled LED circuits in response to the received analog signals. In some examples, power converter 30 may shut down in response to the received signals. In other examples, power converter 30 may pulse or modulate the current communicated to coupled LED circuits in response to the received analog signals. In some embodiments, power converter 30 is operable to receive digital command signals directly. In these embodiments, power converter interface 29 is not implemented. In some embodiments, power converter 30 is operable to transmit signals. For example, power converter 30 may transmit a signal indicating a power failure condition or power out of regulation condition through power converter interface 29 to bus 21.

EIM 120 includes several mechanisms for receiving data from and transmitting data to devices communicatively linked to illumination device 100. EIM 120 may receive and transmit data over PDIC 34, RF transceiver 24, and IR transceiver 25. In addition, EIM 120 may broadcast data by controlling the light output from illumination device 100. For example, processor 22 may command the current supplied by power converter 30 to periodically flash, or otherwise modulate in frequency or amplitude, the light output of LED circuitry 33. The pulses may be detectable by humans, e.g. flashing the light output by illumination device 100 in a sequence of three, one second pulses, every minute. The pulses may also be undetectable by humans, but detectable by a flux detector, e.g. pulsing the light output by illumination device 100 at one kilohertz. In these embodiments, the light output of illumination device 100 can be modulated to indicate a code. Examples of information transmitted by EIM 120 by any of the above-mentioned means includes accumulated elapsed time of illumination device 100, LED failure, serial number, occupancy sensed by occupancy sensor 35, flux sensed by on-board flux sensor 36, flux sensed by flux sensor 32, and temperature sensed by temperature sensor 31, and power failure condition. In addition, EIM 120 may receive messages by sensing a modulation or cycling of electrical signals supplying power to illumination device 100. For example, power line voltage may be cycled three times in one minute to indicate a request for illumination device 100 to communicate its serial number.

Figure 11:
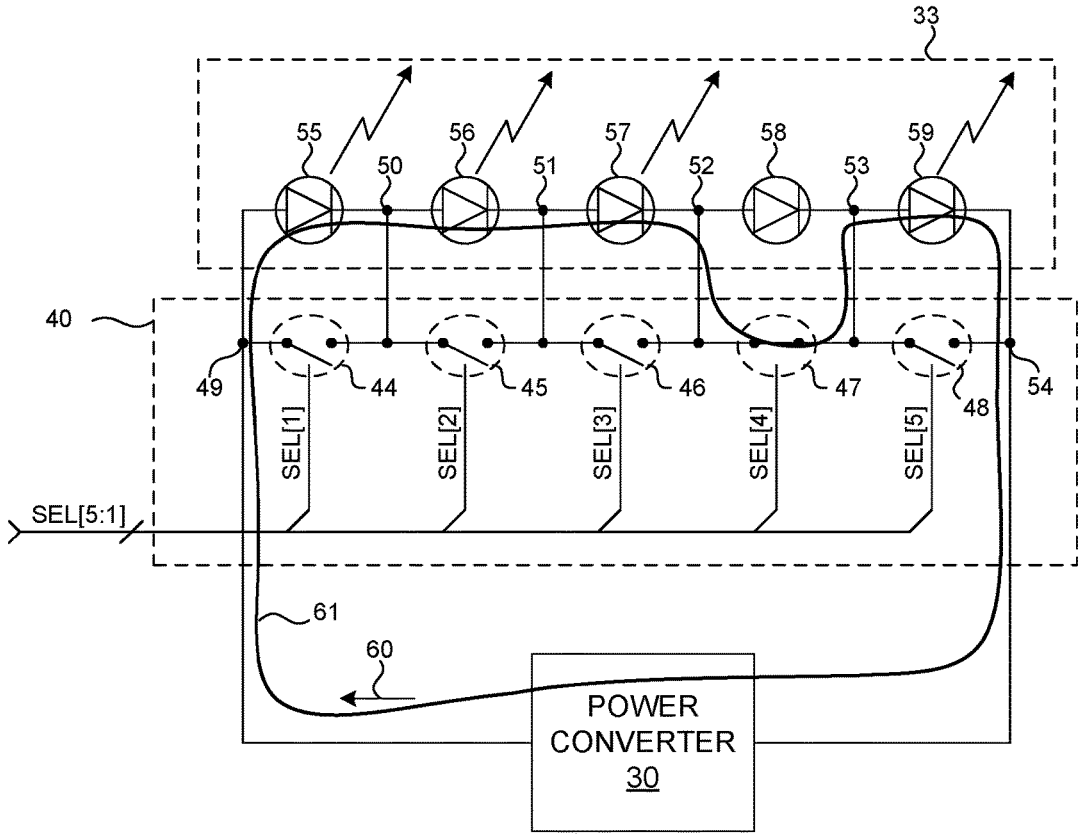
FIG. 11 is a schematic illustrative of an LED selection module.

FIG. 11 is a schematic illustrative of LED selection module 40 in greater detail. As depicted, LED circuitry 33 includes LEDs 55-59 connected in series and coupled to LED selection module 140. Although LED circuit 33 includes five series connected LEDs, more or less LEDs may be contemplated. In addition, LED board 104 may include more than one circuit of series connected LEDs. As depicted, LED selection module 40 includes five series connected switching elements 44-48. Each lead of a switching element is coupled to a corresponding lead of an LED of LED circuit 33. For example, a first lead of switching element 44 is coupled to the anode of LED 55 at voltage node 49. In addition, a second lead of switching element 44 is coupled to the cathode of LED 55 at voltage node 50. In a similar manner switching elements 45-48 are coupled to LEDs 55-58 respectively. In addition, an output channel of power converter 30 is coupled between voltage nodes 49 and 54 forming a current loop 61 conducting current 60. In some embodiments, switching elements 44-48 may be transistors (e.g. bipolar junction transistors or field effect transistors).

LED selection module 40 selectively powers LEDs of an LED circuit 33 coupled to a channel of power converter 30. For example, in an open position, switching element 44 conducts substantially no current between voltage nodes 49 and 50. In this manner, current 60 flowing from voltage node 49 to voltage node 50 passes through LED 55. In this case, LED 55 offers a conduction path of substantially lower resistance than switching element 44, thus current passes through LED 55 and light is generated. In this way switching element 44 acts to "switch on" LED 55. By way of example, in a closed position, switching element 47 is substantially conductive. Current 60 flows from voltage node 52 to node 53 through switching element 47. In this case, switching element 47 offers a conduction path of substantially lower resistance than LED 57, thus current 60 passes through switching element 47, rather than LED 57, and LED 57 does not generate light. In this way switching element 47 acts to "switch off" LED 58. In the described manner, switching elements 44-48 may selectively power LEDs 55-59.

A binary control signal SEL[5:1] is received onto LED selection module 40. Control signal SEL[5:1] controls the state of each of switching elements 44-48, and thus determines whether each of LEDs 55-59 is "switched on" or "switched off." In one embodiment, control signal, SEL, is generated by processor 22 in response to a condition detected by EIM 120 (e.g. reduction in flux sensed by flux sensor 36). In other embodiments, control signal, SEL, is generated by processor 22 in response to a command signal received onto EIM 120 (e.g. communication received by RF transceiver 24, IR transceiver 25, or PDIC 34). In another embodiment, the control signal, SEL, is communicated from an on-board controller of the LED illumination device.

Figure 12:
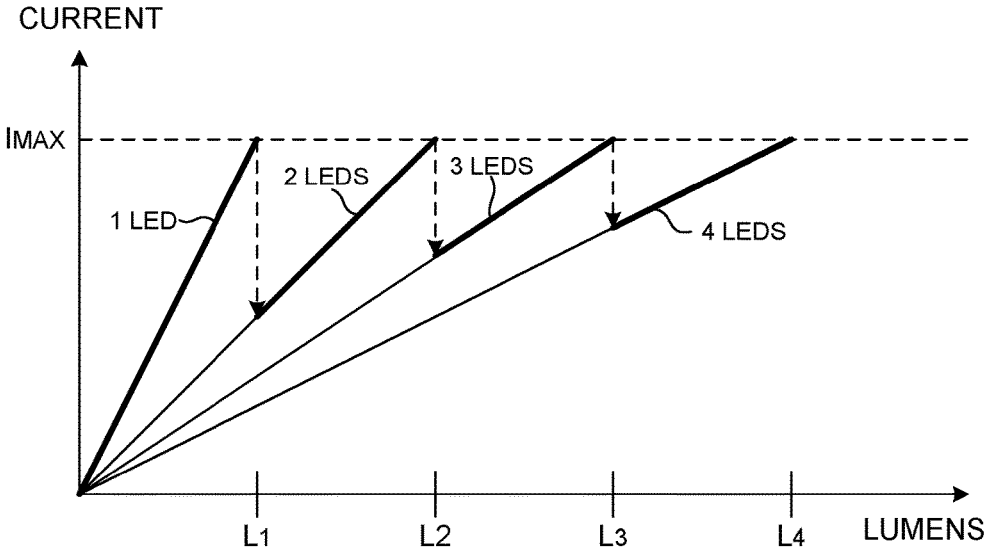
FIG. 12 is a graph illustrative of selecting LEDs to change the amount of flux emitted by powered LEDs.

FIG. 12 is illustrative of how LEDs may be switched on or off to change the amount of flux emitted by powered LEDs of LED circuit 33. Current 60 is plotted against the luminous flux emitted by powered LEDs of LED circuit 33. Due to physical limitations of LEDs 55-59, current 60 is limited to a maximum current level, $I_{max}$, above which lifetime becomes severely limited. In one example, $I_{max}$, may be 0.7 Ampere. In general LEDs 55-59 exhibit a linear relationship between luminous flux and drive current. FIG. 12 illustrates luminous flux emitted as a function of drive current for four cases: when one LED is "switched on", when two LEDs are "switched on", when three LEDs are "switched on", and when four LEDs are "switched on". In one example, a luminous output, $L_3$, may be achieved by switching on three LEDs and driving them at Imax. Alternatively, luminous output, $L_3$, may be achieved by switching on four LEDs and driving them with less current. When reduced amounts of light are required for a period of time (e.g. dimming of restaurant lighting), light selection module 40 may be used to selectively "switch off" LEDs, rather than simply scaling back current. This may be desirable to increase the lifetime of "switched off" LEDs in light fixture by not operating them for selected periods. The LEDs selected to be "switched off" may be scheduled such that each LED is "switched off" for approximately the same amount of time as the others. In this way, the lifetime of illumination device 100 may be extended by extending the life of each LED by approximately the same amount of time.

LEDs 55-59 may be selectively switched on or off to respond to an LED failure. In one embodiment, illumination device 100 includes extra LEDs that are "switched off." However, when an LED failure occurs, one or more of the extra LEDs are "switched on" to compensate for the failed LED. In another example, extra LEDs may be "switched on" to provide additional light output. This may be desirable when the required luminous output of illumination device 100 is not known prior to installation or when illumination requirements change after installation.

Figure 13:
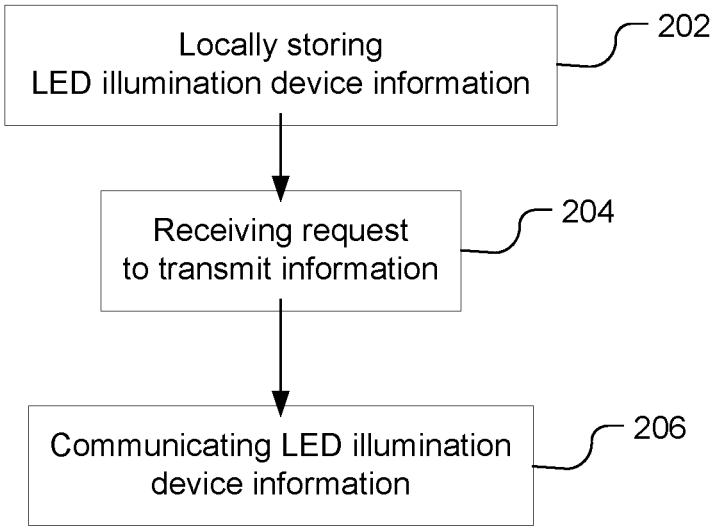
FIG. 13 is a flow chart illustrating a process of externally communicating LED illumination device information.

FIG. 13 is a flow chart illustrating a process of externally communicating LED illumination device information. As illustrated, information associated with the LED illumination device is stored locally, e.g., in non-volatile memory 23 and/or 26 (202). The information, by way of example, may be a LED illumination device identifier such as a serial number, or information related to parameters, such as lifetime, flux, occupancy, LED or power failure conditions, temperature, or any other desired parameter. In some instances, the information is measured, such as lifetime, flux, or temperature, while in other instances, the information need not be measured, such as an illumination device identifier or configuration information. A request for information is received (204), e.g., by RF transceiver 24, IR transceiver, a wired connection, or cycling the power line voltage. The LED illumination device information is communicated (206), e.g., by RF transceiver 24, IR transceiver, a wired connection, or by controlling the light output from illumination device 100.

EIM 120 stores a serial number that individually identifies the illumination device 100 to which EIM 120 is a part. The serial number is stored in non-volatile memory 26 of EIM 120. In one example, non-volatile memory 26 is an erasable programmable read-only memory (EPROM). A serial number that identifies illumination device 100 is programmed into EPROM 26 during manufacture. EIM 120 may communicate the serial number in response to receiving a request to transmit the serial number (e.g. communication received by RF transceiver 24, IR transceiver 25, or PDIC 34). For example, a request for communication of the illumination device serial number is received onto EIM 120 (e.g. communication received by RF transceiver 24, IR transceiver 25, or PDIC 34). In response, processor 22 reads the serial number stored in memory 26, and communicates the serial number to any of RF transceiver 24, IR transceiver 25, or PDIC 34 for communication of the serial number from EIM 120.

EIM 120 includes temperature measurement, recording, and communication functionality. At power-up of illumination device 100, sensor interface 28 receives temperature measurements from temperature sensor 31. Processor 22 periodically reads a current temperature measurement from sensor interface 28 and writes the current temperature measurement to memory 23 as TEMP. In addition, processor 22 compares the measurement with a maximum temperature measurement value (TMAX) and a minimum temperature value (TMIN) stored in memory 23. If processor 22 determines that the current temperature measurement is greater than TMAX, processor 22 overwrites TMAX with the current temperature measurement. If processor 22 determines that the current temperature measurement is less than TMIN, processor 22 overwrites TMIN with the current temperature measurement. In some embodiments, processor 22 calculates a difference between TMAX and TMIN and transmits this difference value. In some embodiments, initial values for TMIN and TMAX are stored in memory 26. In other embodiments, when the current temperature measurement exceeds TMAX or falls below TMIN, EIM 120 communicates an alarm. For example, when processor 22 detects that the current temperature measurement has reached or exceeded TMAX, processor 22 communicates an alarm code over RF transceiver 24, IR transceiver 25, or PDIC 34. In other embodiments, EIM 120 may broadcast the alarm by controlling the light output from illumination device 100. For example, processor 22 may command the current supplied by power converter 30 to be periodically pulsed to indicate the alarm condition. The pulses may be detectable by humans, e.g. flashing the light output by illumination device 100 in a sequence of three, one second pulses every five minutes. The pulses may also be undetectable by humans, but detectable by a flux detector, e.g. pulsing the light output by illumination device 100 at one kilohertz. In these embodiments, the light output of illumination device 100 could be modulated to indicate an alarm code. In other embodiments, when the current temperature measurement reaches TMAX, EIM 120 shuts down current supply to LED circuitry 33. In other embodiments, EIM 120 communicates the current temperature measurement in response to receiving a request to transmit the current temperature.

EIM 120 includes elapsed time counter module 27. At power-up of illumination device 100, an accumulated elapsed time (AET) stored in memory 23 is communicated to ETCM 27 and ETCM 27 begins counting time and incrementing the elapsed time. Periodically, a copy of the elapsed time is communicated and stored in memory 23 such that a current AET is stored in non-volatile memory at all times. In this manner, the current AET will not be lost when illumination device 100 is powered down unexpectedly. In some embodiments, processor 22 may include ETCM functionality on-chip. In some embodiments, EIM 120 stores a target lifetime value (TLV) that identifies the desired lifetime of illumination device 100. The target lifetime value is stored in non-volatile memory 26 of EIM 120. A target lifetime value associated with a particular illumination device 100 is programmed into EPROM 26 during manufacture. In some examples, the target lifetime value may be selected to be the expected number of operating hours of illumination device 100 before a 30% degradation in luminous flux output of illumination device 100 is expected to occur. In one example, the target lifetime value may be 50,000 hours. In some embodiments, processor 22 calculates a difference between the AET and the TLV. In some embodiments, when the AET reaches the TLV, EIM 120 communicates an alarm. For example, when processor 22 detects that the AET has reached or exceeded the TLV, processor 22 communicates an alarm code over RF transceiver 24, IR transceiver 25, or PDIC 34. In other embodiments, EIM 120 may broadcast the alarm by controlling the light output from illumination device 100. For example, processor 22 may command the current supplied by power converter 30 to be periodically pulsed to indicate the alarm condition. The pulses may be detectable by humans, e.g. flashing the light output by illumination device 100 in a sequence of three, one second pulses every five minutes. The pulses may also be undetectable by humans, but detectable by a flux detector, e.g. pulsing the light output by illumination device 100 at one kilohertz. In these embodiments, the light output of illumination device 100 could be modulated to indicate an alarm code. In other embodiments, when the AET reaches the TLV, EIM 120 shuts down current supply to LED circuitry 33. In other embodiments, EIM 120 communicates the AET in response to receiving a request to transmit the AET.

Figure 14:
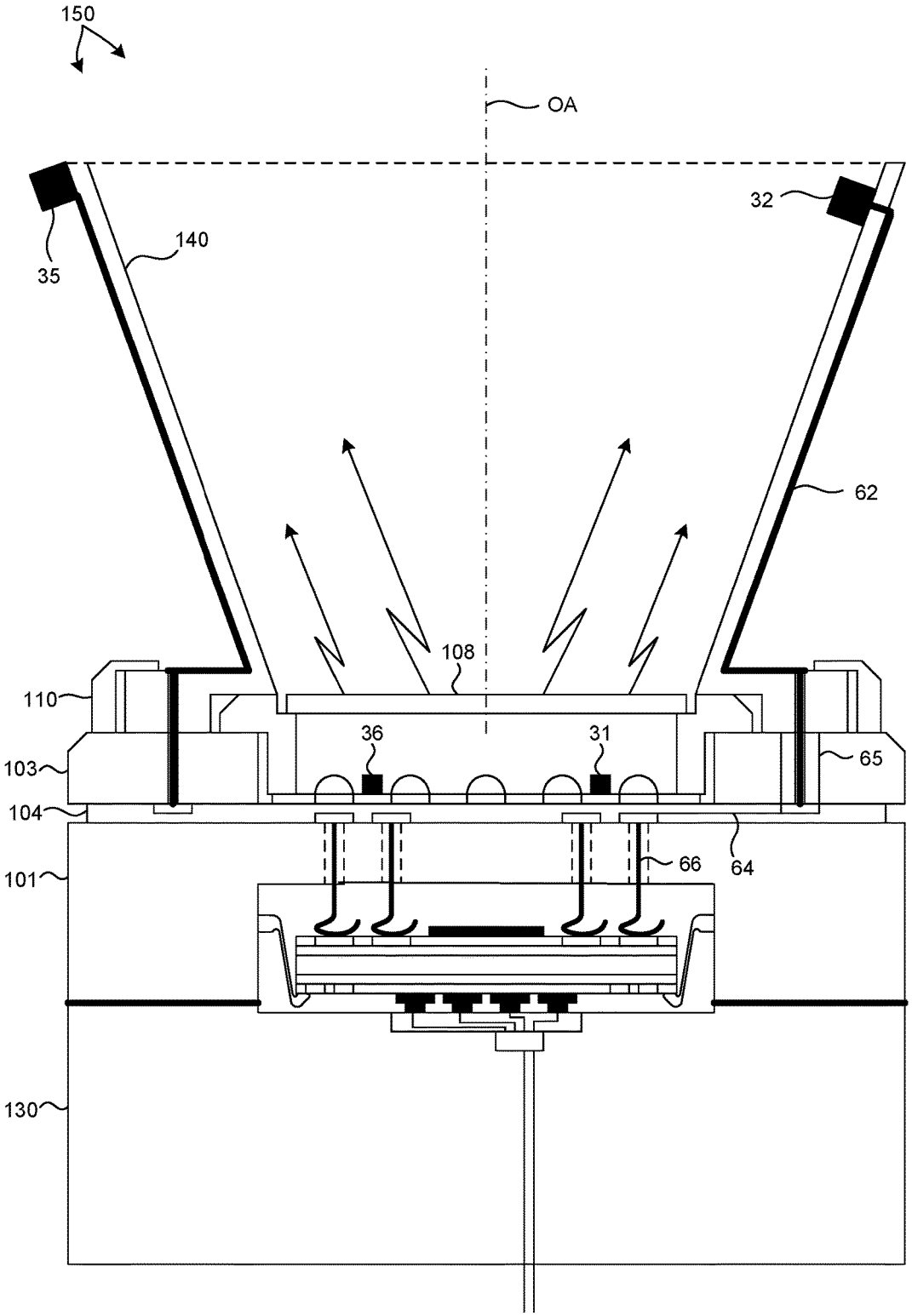
FIG. 14 illustrates an optic in the form of a reflector that includes at least one sensor that is in electrical contact with the electrical interface module.

FIG. 14 illustrates an optic in the form of reflector 140 that includes at least one sensor and at least one electrical conductor. FIG. 14 illustrates flux sensor 32 mounted on an interior surface of reflector 140. Sensor 32 is positioned such that there is a direct line-of-sight between the light sensing surfaces of sensor 32 and output window 108 of illumination device 100. In one embodiment, sensor 32 is a silicon diode sensor. Sensor 32 is coupled to electrical conductor 62. Conductor 62 is a conductive trace molded into reflector 140. In other embodiments, the conductive trace may be printed onto reflector 140. Conductor 62 passes through the base of reflector 140 and is coupled to a conductive via 65 of mounting board retaining ring 103 when reflector 140 is mounted to illumination device 100. Conductive via 65 is coupled to conductor 64 of mounting board 104. Conductor 64 is coupled to EIM 120 via spring pin 66. In this manner, flux sensor 32 is electrically coupled to EIM 120. In other embodiments, conductor 62 is coupled directly to conductor 64 of mounting board 104. Similarly, occupancy detector 35 may be electrically coupled to EIM 120. In some embodiments, sensors 32 and 35 may be removably coupled to reflector 140 by means of a connector. In other embodiments, sensors 32 and 35 may be fixedly coupled to reflector 140.

Figure 15:
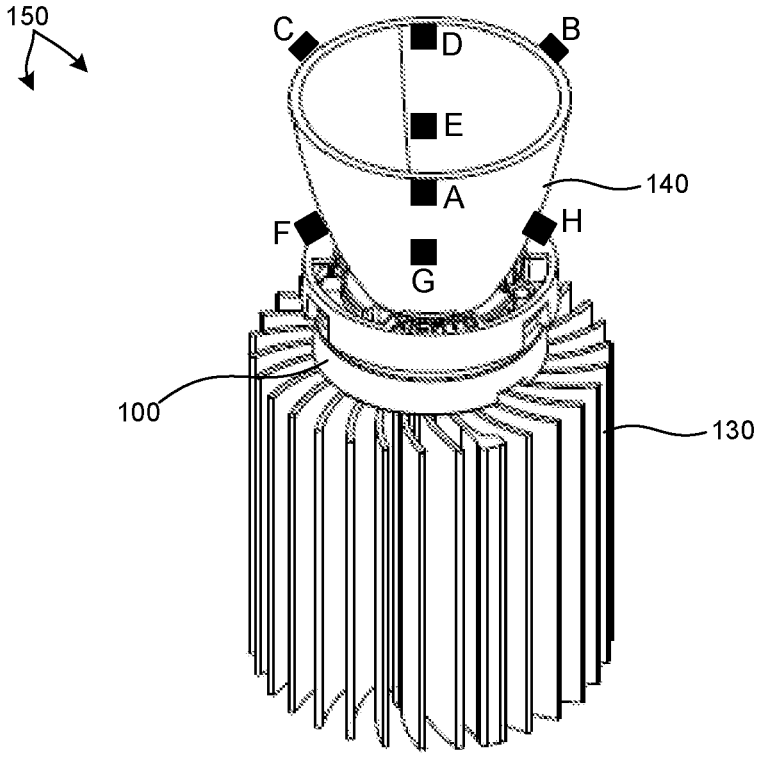
FIG. 15 is illustrative of locations on the reflector sensors may be positioned.

FIG. 14 also illustrates flux sensor 36 and temperature sensor 31 attached to mounting board 104 of illumination device 100. Sensors 31 and 36 provide information about the operating condition of illumination device 100 at board level. Any of sensors 31, 32, 35, and 36 may be one of a plurality of such sensors placed at a variety of locations on mounting board 104, reflector 140, light fixture 130, and illumination device 100. In addition, a color sensor may be employed. FIG. 15 is illustrative of locations where color, flux, and occupancy sensors may be positioned on reflector 140 for exemplary purposes. In one example, sensors may be located in locations A, B, and C. Locations A-C are outwardly facing so that sensors disposed at locations A-C may sense color, flux, or occupancy of a scene illuminated by illumination device 100. Similarly, sensors at locations F, G, and H are also outwardly facing and may sense color, flux, or occupancy of a scene illuminated by illumination device 100. Sensors may also be disposed at locations D and E. Locations D and E are inwardly facing and may detect flux or color of the illuminance of illumination device 100. The locations of sensors D and E differ in their angle sensitivity to light output by illumination device 100 and differences may be used to characterize the properties of light output by illumination device 100.

Although certain specific embodiments are described above for instructional purposes, the teachings of this patent document have general applicability and are not limited to the specific embodiments described above. For example, illumination device 100 is described as including mounting base 101. However, in some embodiments, mounting base 101 may be excluded. In another example, EIM 120 is described as including bus 21, powered device interface controller (PDIC) 34, processor 22, elapsed time counter module (ETCM) 27, an amount of non-volatile memory 26 (e.g. EPROM), an amount of non-volatile memory 23 (e.g. flash memory), infrared transceiver 25, RF transceiver 24, sensor interface 28, power converter interface 29, power converter 30, and LED selection module 40. However, in other embodiments, any of these elements may be excluded if their functionality is not desired. In another example, PDIC 34 is described as complying with the IEEE 802.3 standard for communication. However, any manner of distinguishing power and data signals for purposes of reception and transmission of data and power may be employed. In another example, LED based illumination module 100 is depicted in FIGS. 1-2 as a part of a luminaire 150. However, LED based illumination module 100 may be a part of a replacement lamp or retrofit lamp or may be shaped as a replacement lamp or retrofit lamp. Accordingly, various modifications, adaptations, and combinations of various features of the described embodiments can be practiced without departing from the scope of the invention as set forth in the claims.

What is claimed is:

1. An apparatus comprising:

an LED illumination device operable to emit a light, wherein the LED illumination device includes an LED selection module mounted to an electrical interface module, the LED selection module comprising:

a first voltage node adapted to be coupled to a first terminal of an LED;

a second voltage node adapted to be coupled to a second terminal of the LED;

a switching element coupled between the first voltage node and the second voltage node, wherein the switching element is substantially conductive in a closed state, and wherein the switching element in the closed state is operable to conduct a current supplied by a current source; and a conductor coupled to the switching element, wherein a control signal communicated over the conductor determines whether the switching element is in the closed state;

the electrical interface module comprising:

a first plurality of electrical contact surfaces in a first arrangement disposed on an electrical interface board;

a second plurality of electrical contact surfaces in a second arrangement disposed on the electrical interface board;

a first conductor coupling a first electrical contact surface of the first plurality of electrical contact surfaces to a first electrical contact surface of the second plurality of electrical contact surfaces, wherein the first plurality of electrical contact surfaces is configured to be electrically coupleable to LEDs in the LED illumination device, and wherein the second plurality of electrical contact surfaces is configured to be electrically coupleable to a light fixture.

2. The apparatus of claim 1, further comprising:

a controller that provides the control signal to the switching element.

3. The apparatus of claim 2, wherein the controller is mounted to the electrical interface module of the LED based illumination device.

4. The apparatus of claim 2, wherein the controller provides the control signal that determines whether the switching element is in the closed state based on a command received by the controller.

5. The apparatus of claim 2, wherein the controller provides the control signal that determines whether the switching element is in the closed state based on a flux sensed on the LED illumination device.

6. The apparatus of claim 1, wherein the electrical interface module further comprises:

a frame including a plurality of pins operable to electrically couple the first plurality of electrical contact surfaces of the electrical interface board to the LEDs in the LED illumination device.

7. The apparatus of claim 6, wherein the electrical interface module further comprises:

a second conductor coupling the first electrical contact surface of the first plurality of electrical contact surfaces with a second electrical contact surface of the second plurality of electrical contact surfaces.

8. The apparatus of claim 6, wherein the first plurality of electrical contact surfaces of the electrical interface board is adapted to be electrically coupleable to LED illumination devices with a different number of LEDs.

* * * * *